United States Patent [19]

Takita

[11] B 3,990,088

[45] Nov. 2, 1976

[54] SYSTEM FOR CONTROLLING REPLENISHMENT OF DEVELOPER SOLUTION IN A PHOTOGRAPHIC PROCESSING DEVICE

[75] Inventor: Nobuhiro Takita, Kyoto, Japan

[73] Assignee: LogEtronics Inc., Springfield, Va.

[22] Filed: July 17, 1974

[21] Appl. No.: 489,328

[44] Published under the second Trial Voluntary Protest Program on January 20, 1976 as document No. B 489,328.

[30] Foreign Application Priority Data

Nov. 28, 1973 Japan ..... 48-134220

[52] U.S. Cl. ..... 354/298; 137/93; 354/324

[51] Int. Cl.[2] ..... G03D 13/00

[58] Field of Search ..... 354/297, 298, 299, 324, 354/334, 336; 134/57 R, 64 P; 137/93

[56] References Cited

UNITED STATES PATENTS

| | | | |
|---|---|---|---|
| 3,529,529 | 9/1970 | Schumacher | 354/297 X |
| 3,559,555 | 2/1971 | Street | 354/298 |
| 3,712,203 | 1/1973 | Kishi et al. | 354/324 X |
| 3,787,689 | 1/1974 | Fidelman | 354/298 X |

*Primary Examiner*—Fred L. Braun
*Attorney, Agent, or Firm*—Pollock, VandeSande & Priddy

[57] ABSTRACT

The chemical activity of the developer in a film processor is stabilized by a replenishment system which includes a controlled fluid supply arrangement operative to effect an initial replenishment based upon certain predetermined factors including the length or area of a sheet to be processed as detected at the processor input, an assumed minimum exposure present on each image-bearing sheet to be processed, and the customary degradation of developer activity resulting from oxidation effects as determined empirically. The initial replenishment is later supplemented, if necessary, by effecting additional replenishment following the processing of film sheets, based upon a determination of the actual image density and image area present in those sheets. Variations in developer activity, due to introduction of the initial and supplemental replenishment fluid increments, are minimized by providing a mixing tank in parallel with at least a portion of the main developing tank in the processor, to increase the effective volume of developer solution in the overall system.

15 Claims, 5 Drawing Figures

FIG. 3.
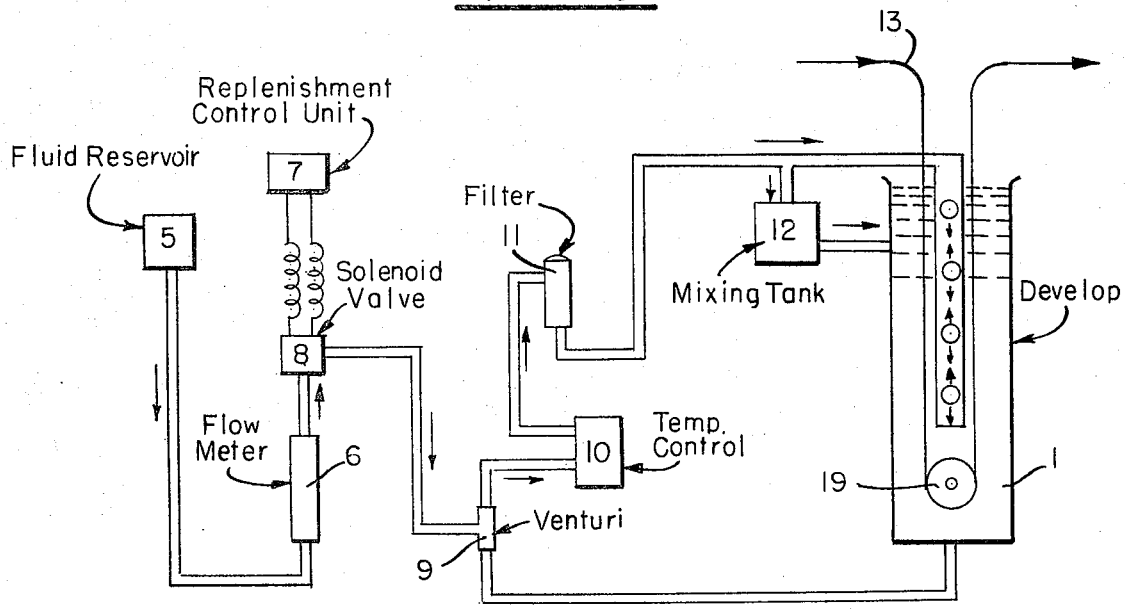
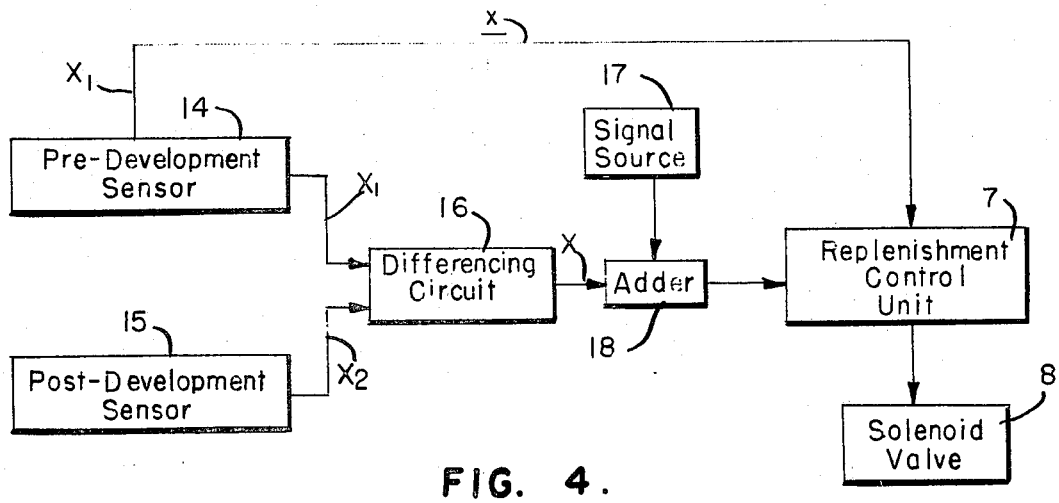
FIG. 4.

SYSTEM FOR CONTROLLING REPLENISHMENT OF DEVELOPER SOLUTION IN A PHOTOGRAPHIC PROCESSING DEVICE

BACKGROUND OF THE INVENTION

Various forms of automatic film processors adapted to develop, fix, wash and dry sheets of exposed photosensitive material are already known to those skilled in the art. In such processors, sheets of material to be processed are fed sequentially from one fluid-containing treatment tank to the next, and the developed, fixed, and washed material is then passed through a dryer and transferred to a collection bin. In the normal operation of machines of this type the chemical solutions employed for processing the photosensitive material tend to become depleted in activity and volume when such material is processed and, unless chemical replenishment is effected during continued operation, severe degradation in the image quality of the developed films will result. It is, accordingly, customary to include some type of controllable replenishment facility intended to maintain the chemical concentrations in the processing tanks at desired and stable levels of activity, and within specific limits of volume and concentration.

Many forms of developer replenishment systems, both manual and automatic, are already known to those skilled in the art, as typified by Van Bouwel, U.S. Pat. No. 3,368,472 which discloses a device for maintaining a developing bath in an automatic film processor at a predetermined level of activity by delivering measured quantities of replenishment fluid to the bath under the control of an electro-mechanical system which detects the arrival of each film sheet and monitors its passage through a physical-contact sensing device located at the input of the processing apparatus. Similarly, Street U.S. Pat. Nos. 3,554,109 and 3,559,555, both assigned to the Assignee of this Application, disclose highly accurate non-contact replenishment control systems which utilize electro-optical scanners to measure and integrate information corresponding to the developed image densities present throughout the complete area of the processed films, and employ this information to automatically control the transfer of precise increments of chemical replenishment fluid from storage receptacles to the processor tanks, in order to counteract the degradation in solution activity which always results from the development of exposed photosensitive material, and which is particularly pronounced in machines utilizing shallow processing tanks having small fluid capacities.

However, despite the high levels of technical sophistication which have been achieved, automatic replenishment systems continue to exhibit sources of inaccuracy, including:

a. A tendency to over-develop images for a short period of time subsequent to each introduction of an increment of replenishing fluid into the main developing tank. This deficiency results from the finite time period which elapses while the replenished developing fluid is returning to the essentially homogeneous state in which it had existed prior to the replenishment cycle.

b. Failure to provide adequate compensation for the gradual loss in developing activity which results from oxidation of the fluid, both during development operations and also while the processor is operative but not engaged in developing film.

When control of replenishment is effected by a film-length or area-sensing measuring system, it is usually very difficult to maintain constancy of developing activity of the developing fluid, because the effective exposed image area of the film to be developed is not known with sufficient precision even though this is the principal source of developer depletion. In other replenishment systems, where the supply of replenishment fluid is controlled cyclically by the detection and integration of increments of information representing the developed image area on the film being processed, it is difficult to obtain consistent replenishment results because the developer activity decreases subsequent to each replenishment cycle and until more replenisher is supplied as a result of the detection and integration of a further predetermined amount of image area information. Furthermore, in conventional prior art film processors, replenishing fluid is usually supplied directly to the developing tank, resulting in an almost instantaneous increase in developer activity, followed soon thereafter by the decrease previously described. Therefore, when continuous lengths — as opposed to individual cut sheets — are processed, uneven density of the developed images can easily occur.

SUMMARY OF THE INVENTION

The present invention, recognizing the disadvantages of prior art approaches, has as its objective the elimination of faults encountered in conventional methods of maintaining development activity in automatic film processors. By use of the invention, the activity of the fluid in the developing tank of such a film processor is maintained at a substantially constant value at all times, thereby stabilizing the developing operation.

The system of the present invention includes a controlled fluid supply arrangement operative to effect initial replenishment in a film processor (i.e., prior to the time a given sheet of film to be processed has passed through the developing fluid in the processor) based upon certain standard parameters and/or predetermined factors e.g., (a) the length or area of a sheet to be processed as detected at the processor input, (b) an assumed minimum exposure present on each image-bearing sheet to be processed, and (c) customary degradation of developer activity resulting from oxidation effects, as determined empirically. The initial replenishment is supplemented, if necessary, by effecting additional replenishment after one or more film sheets have been processed, based upon a determination of the actual image density and image area present in those sheets. In addition, variations in developer activity, due to introduction of the initial and supplemental replenishment fluid increments, are "smoothed out" and minimized by providing a mixing tank in parallel with at least a portion of the main developing tank in the processor, to pre-mix the replenishment fluid with the working developer solution and to increase the effective volume of developer solution in the overall system.

BRIEF DESCRIPTION OF THE DRAWINGS

FIGS. 2A and 2B are graphic representations of variation in developer activity, plotted against elapsed time prior and subsequent to the initiation of a replenishment cycle, in which FIG. 2A depicts the performance obtained in a system of the prior art, and FIG. 2B illustrates the improved performance provided by the present invention;

FIG. 3 is a schematic diagram of the developing and replenishing section of an automatic film processor employing the present invention; and FIG. 4 is a block diagram of one embodiment of the control system of the present invention.

DESCRIPTION OF THE PREFERRED EMBODIMENTS

Figure 1:
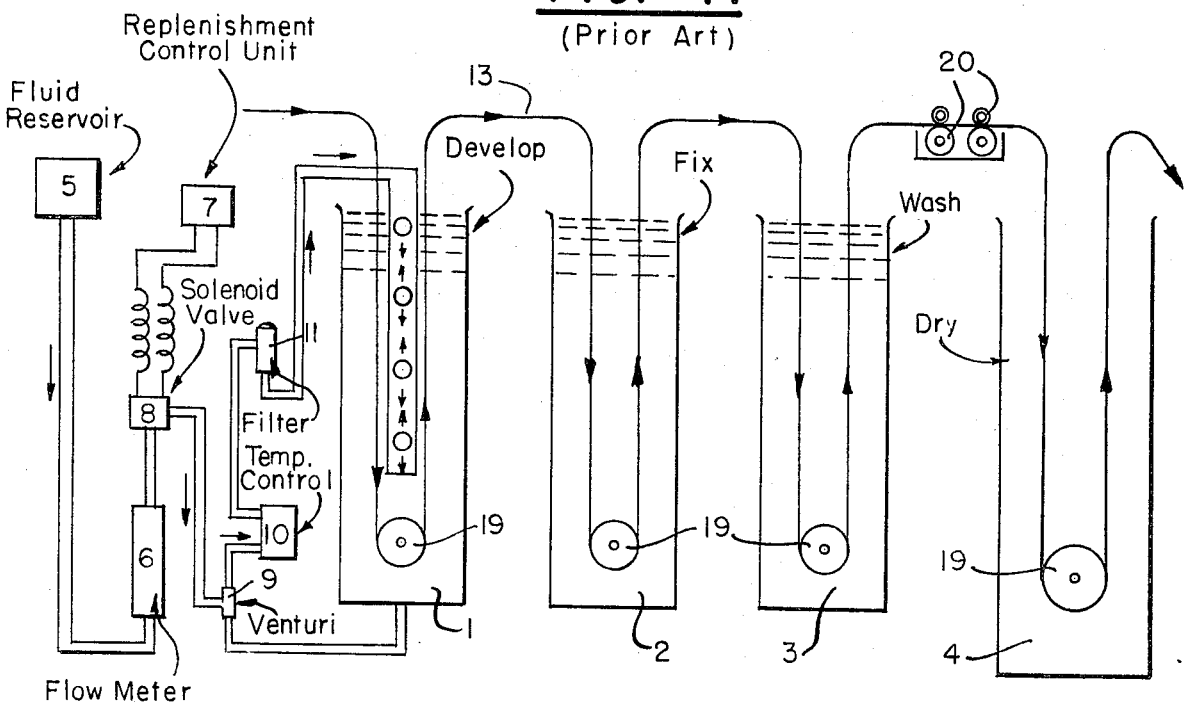
FIG. 1. (Prior Art)
FIG. 1 is a schematic diagram of an automatic film processor incorporating a replenishment control system of the prior art.

Referring initially to FIG. 1, a conventional automatic film processor may comprise a developing tank 1, a fixing tank 2, a wash tank 3, and a dryer 4. Exposed sensitized material to be developed is fed in sequence through tanks 1, 2 and 3, along a path generally designated 13, by means of an appropriate transport system diagrammatically illustrated by rollers 19. Squeegee rollers 20 are located downstream of wash tank 3, and the developed film is caused to pass through said squeegee rollers for partial drying, whereafter the film is fed through a dryer 4 for final drying and subsequent collection. Apparatuses of this general type are in themselves well known.

In order to minimize the loss in chemical activity of the fluid contained in tank 1 resulting from the development of exposed film and from oxidation due to contact between the fluid and atmospheric or entrapped air, it has been customary to add replenishing fluid, as required, by opening a solenoid valve 8 associated with a replenishment control unit 7, fluid reservoir 5 and flow meter 6. Such replenishment control is often effected by measurement of the physical length or area of the film fed into developing tank 1, or by subsequent measurement of the effective area of the developed image present on the film. The controlled opening of solenoid valve 8 allows an appropriate amount of replenisher, stored in reservoir tank 5, to be drawn into developing tank 1 as a result of the combined action of venturi tube 9, fluid temperature control unit and circulating pump 10 and filter 11, all of which in combination constitute the circulation and conditioning system for the fluid contained in tank 1.

For simplicity, the reference numerals of FIG. 1 are used to identify like components shown in the preferred embodiment of the invention illustrated in FIG. 3, wherein a developing tank 1 is coupled to a reservoir 5, from which replenishing fluid can be transferred via flow meter 6 which indicates the rate of flow of fluid from tank 5. A replenishment control unit 7, associated with the control system to be described hereinafter with respect to FIG. 4, actuates replenishment solenoid valve 8 and is, itself, associated with sensor 14 (FIG. 4), disposed adjacent the input of the processor to detect the size of each film sheet fed into the processor. A venturi tube 9 is used to couple replenishing fluid from reservoir 5 to the developer circulation system to be described hereinafter, and a temperature control unit and circulating pump 10 are provided to adjust and maintain the fluid in tank 1 at the temperature best suited to the film development operation. A filter 11 is used to remove suspended matter from the circulating fluid. Thus, developing tank 1, unit 10 and filter 11 form the developer circulation system, with any excess developer being allowed to overflow from tank 1 via a mechanism not shown. A subsidiary mixing tank 12 is interconnected with developing tank 1 and is arranged to receive a portion of the fluid flowing through the developer circulation system. Numeral 13 represents the path along which the film to be treated is conveyed.

FIG. 4 depicts in block diagram form the control unit 7 of FIG. 3 and its associated inputs. A pre-development sensor 14, such as a microswitch or infrared sensing system, located adjacent the input tray of the processor, is provided to detect the presence of film sheets as they are fed into the processor, and to generate a first electrical output signal representing the actual film sheet length or its area. A similar first electrical signal can be provided, instead, by an operator-controlled manually-actuated device such as a dial or push-button arrangement of known types. A post-development sensor 15, located in the vicinity of squeegee rollers 20 (FIG. 1), detects and integrates information concerning the actual areas of developed image density present on each processed film sheet and provides a second electrical output signal representing this information.

The output signal from pre-development sensor 14 is coupled directly to control unit 7 to effect an initial replenishment. In addition, the output signals provided by sensors 14 and 15 are coupled to a differencing or comparison circuit 16 which produces a resultant output signal indicative of any difference existing between the two sensor signals, and this information is combined, in adder circuit 18, with the output signal from a signal generating circuit 17 which is operative to compensate for the lowering of developer activity with the passage of time as a result of developer oxidation effects occurring in tank 1. The output of adding circuit 18 is also coupled to control unit 7 of FIG. 3, to actuate solenoid valve 8 thereby achieving appropriate additional replenishment of the fluid in tank 1 when such additional replenishment is required.

The parameters employed to control replenishment can be derived, and employed, in a variety of different ways. For example, the pre-development sensor 14 can be associated with a control circuit calibrated to operate in accordance with the formula $$\frac{S_1'}{S_1}(a) = X_1$$

where $S_1$ represents an assumed basic film size (or length in the case of standard width sheets) for every sheet to be processed, $S_1'$ represents the actual size of the film sheet being processed as sensed by sensor 14, $(a)$ represents the amount of replenishment required for processing the sheet of film of the basic film size having at least a basic level of image exposure thereon, and $X_1$ represents the initial replenishment increment which must be effected to compensate for the lowered chemical activity which will result during subsequent processing, based on these factors. The signal representative of $X_1$, as shown in FIG. 4, is fed from sensor 14 via line $x$ directly to replenishment control unit 7 which controls the actuation of solenoid valve 8. However the $X_1$ signal may be fed instead to a storage unit, e.g., a capacitor or integrating circuit, for later utilization if, at the time, solenoid valve 8 is already in its open condition as a result of a signal being supplied to control unit 7 from adder 18.

The post-development sensor 15 may constitute a structure of the type shown in one of the aforementioned Street patents, and can be associated with a control ciircuit calibrated to operate in accordance with the formula $$\frac{S_2'}{S_2}(b) = X_2$$

where $S_2$ represents the assumed basic image density and area in each processed sheet, $S_2'$ represents the actual integrated image density in the processed sheet or sheets, ($b$) represents the amount of replenishment required to compensate for the decrease in developer activity resulting from the actual processing of the sheet or sheets, and $X_2$ represents a value of supplemental replenishment required to compensate for the actual image conditions in the processed sheet or sheets.

Circuit 16 operates, in effect, to compare the signals provided by sensors 14 and 15, and is calibrated in accordance with the formula $$X_2 - X_1 = X \text{ (where } X_2 \geqslant X_1)$$

where $X$ represents an increment of post-development replenishment which is required to compensate for any inadequacy in initial replenishment. The resultant signal output from circuit 16, which is representative of $X$, is, as shown in FIG. 4, fed from circuit 16 to adder 18, but it may instead be temporarily stored for later use, in the general manner previously described, to avoid interference with any pre-development sensor signal which, at the time, is being fed directly to replenishment control unit 7 from sensor 14 via line $x$. Any signal fed to adder 18 is increased in magnitude by a further signal supplied by source 17 (which may, if desired, be associated with a memory or integrating circuit) which controls a further increment of replenishment to compensate for the continual, slow degradation of developer activity due to oxidation effects, and the composite signal supplied by adder 18 (or the signal from source 17 alone, if there is no output from circuit 16) is then fed to control unit 7 to control the opening of solenoid valve 8 thereby to effect the required additional replenishment.

The various memories and integrating circuits referred to previously may be incorporated into control unit 7. The amount of replenishment supplied in each increment of pre-development and post-development replenishment is a function of the time that solenoid valve 8 is open since the replenishment flow rate is pre-established by adjustment of flowmeter 6.

In accordance with a further aspect of the present invention, a mixing tank 12 is provided which has its fluid flow path arranged to be at least partially in parallel with developer tank 1 to stabilize the developer activity, and to increase the effective fluid capacity of developer tank 1. The replenishing fluid from reservoir 5 is not supplied in its entirety directly to tank 1, approximately one-half of the flow being first directed via an input line to subsidiary mixing tank 12, from which it thereafter circulates via a mixing tank output line to tank 1. The relationship between the variation of developer activity ($\Delta A$), the quantity of developer solution (V) in the processor, and the developed image area of a processed film sheet (S) can be represented by the formula $|\Delta A| = SC/V$ where $C$ is a constant determined by the sensitometric characteristics of the developer/film combination being employed. The variation of developer activity can be further represented by the formula $|\Delta A| \sim R/V$, where R represents the quantity of added replenishment fluid. Consideration of these two formulas establishes that the value of $\Delta A$ (i.e., the variation in developer activity) will be reduced when $V$ is increased. In accordance with the present invention, therefore, the developer activity is effectively stabilized, notwithstanding the fact that replenishment fluid is supplied from time to time, by the use of the subsidiary mixing tank 12 which effectively increases the quantity of developing fluid (V) in the processor.

Figure 2A:
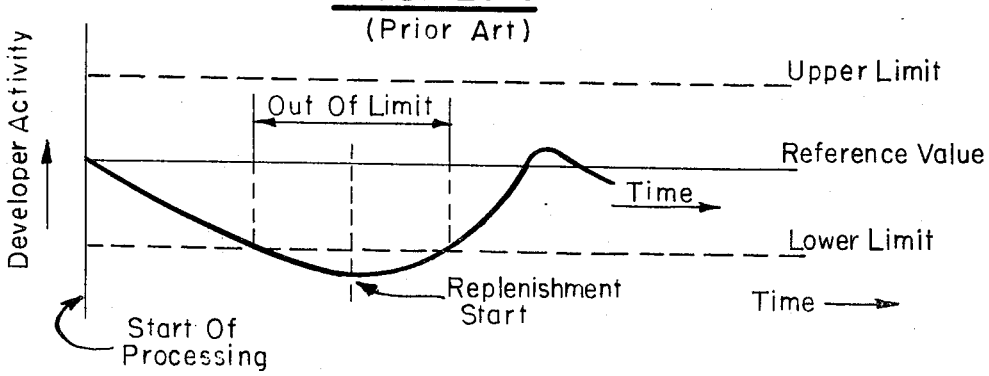
FIG. 2A. (Prior Art)
Figure 2B:
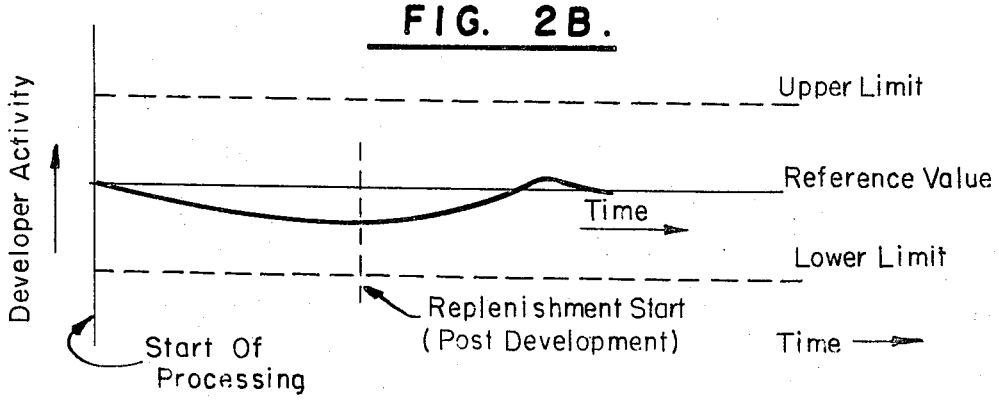

The results of these features of the present invention are graphically shown in FIGS. 2A and 2B. FIG. 2A depicts variations in developer activity in a prior art processor replenishment system. Subsequent to commencement of a processing operation, the activity of the developer fluid tends to decrease and, since the start of replenishment is delayed until a time subsequent to the start of processing due to the fact that replenishment is determined by monitoring a sheet of film after it has been processed, the actual activity may decrease beyond an established lower limit both before and immediately subsequent to the commencement of the replenishment operation. If plural sheets of film are fed into the processor continuously, the developer activity may fall to an unacceptably low level before the first sheet of film reaches the post-development sensor to initiate the replenishment activity, and sheets of film fed into the processor subsequent to the first sheet and prior to the commencement of replenishment may accordingly be underdeveloped. Moreover, after replenishment has been initiated the developer activity rises and may exceed a desired reference value (and may indeed exceed the illustrated upper limit) for a period of time. Sheets of film fed into the processor during this period of time will accordingly tend to be overdeveloped. This undesirable result is due in part to the fact that the added replenishment fluid may constitute a significant portion of the total effective developer solution, and is due also to the fact that the replenishment fluid is supplied substantially directly to the developer tank and, for a period of time, may be inadequately mixed with the working developer and tends to be stratified adjacent its point of injection.

The improved results achieved by the present invention are depicted in FIG. 2B. By reason of the fact that (a) both pre-processing and post-development replenishment is employed, (b) the effective quantity of developer solution is increased relative to the quantity of added replenishment chemical, and (c) the replenishment chemical is at least partially mixed or homogenized with the main developer solution at a location external of the developer tank 1, the developer activity tends to decrease to a far smaller extent, and does not fall outside the aforementioned upper and lower limit at any time; and, once replenishment has been effected, the developer activity normally exceeds the aforementioned reference value to a far lesser extent. In short, the developing activity in tank 1 is kept essentially constant, as shown in FIG. 2B, even after a quantity of replenishing fluid has been introduced into the system via venturi 9.

Having thus described my invention, I claim:

1. In a film processor of the type comprising developing, fixing and washing tanks, means for transporting exposed film along a predetermined path from the input of said processor through said tanks in succession to the output of said processor, a supply of replenishment fluid, and control means operative to selectively feed a fluid increment from said supply to replenish the developer solution in said developing tank thereby to compensate for the lowered activity of said developer solution resulting from the processing of said film, the improvement comprising a mixing tank containing developer solution, said mixing tank being connected in parallel with at least a portion of said developing tank for increasing the effective volume of developer solution in said processor, said parallel connection being effected by fluid flow inlet lines connecting said replenishment supply via said control means to both said mixing tank and said developing tank for casuing a portion of each such fluid increment to flow into said mixing tank while the remaining portion of said fluid increment flows directly into said developing tank, and a fluid flow outlet line connecting said mixing tank to said developing tank for supplying additional fluid to said developing tank after the portion of said increment supplied to said mixing tank has been mixed with fluid pre-existing in said mixing tank.

2. The processor of claim 1 wherein said inlet flow lines are operative to cause substantially one-half of each such increment to flow into said mixing tank while the remainder of said increment flows into said developing tank.

3. The processor of claim 2 wherein said control means includes a normally closed solenoid valve, and sensor means disposed adjacent said transport path for selectively supplying an electrical signal operative to open said solenoid valve thereby to feed said increment from said supply to said inlet flow lines.

4. The processor of claim 3 wherein said sensor means comprises a first sensor disposed adjacent said path upstream of said developing tank for supplying a predevelopment signal operative to control said solenoid valve to selectively feed an increment of replenishment fluid from said supply at the time a sheet of film is being fed into said processor, and a second sensor disposed adjacent said path downstream of said developing tank for supplying a post-development signal operative to control said solenoid valve to selectively feed a further increment of replenishment fluid from said supply after a sheet of film has been developed in said processor.

5. The processor of claim 4 wherein said first sensor is responsive to a dimensional parameter of a film sheet to be processed.

6. The processor of claim 4 wherein said second sensor is responsive to a parameter of the image present in a processed film sheet.

7. The processor of claim 4 including a control circuit connected to both said first sensor and to said second sensor for subtracting said pre-development and post-development signals from one another to produce a difference signal operative to control said solenoid valve.

8. The processor of claim 7 including means for generating a further signal representative of replenishment needed to compensate for degradation of developer activity resulting from oxidation effects, said control circuit including adder means responsive to said difference signal and to said further signal for producing a resultant signal operative to control said solenoid valve.

9. In a film processor of the type comprising developing, fixing, and washing tanks, means for transporting exposed film along a predetermined path from the input of said processor through said tanks in succession to the output of said processor, a supply of replenishment fluid, and control means operative to selectively feed fluid from said supply to replenish the developer in said developing tank thereby to compensate for the lowered activity of said developer resulting from the processing of said film, the improvement comprising a pre-development sensor disposed adjacent said transport path upstream of said developing tank and responsive to at least the presence of a sheet of film at the processor input for activating said control means to feed an initial increment of replenishment fluid from said supply to said developing tank prior to the processing of said sheet, and a post-development sensor disposed adjacent said transport path downstream of said fixing tank and responsive to at least the image density in at least one processed sheet of film for selectively activating said control means to feed a further increment of replenishment fluid from said supply to said developing tank subsequent to the film processing operation.

10. The processor of claim 9 including a mixing tank containing developer solution, said mixing tank being located outside of said transport path, an outlet flow line connecting said mixing tank to said developer tank, and an inlet flow line connected to said mixing tank for supplying at least a portion of each of said initial and further replenishment increments to said mixing tank for mixing with developer solution already in said mixing tank whereafter the mixed solution is supplied from said mixing tank via said outlet flow line to said developing tank.

11. The processor of claim 9 wherein said control means includes an electrically operated valve, each of said sensors being operative to produce an electrical signal, means for comparing said sensor signals and operative to produce a resultant signal representative of the difference between said sensor signals, and means coupling said resultant signal to said electrically operated valve to control its operation.

12. The processor of claim 11 including means coupling the electrical signal produced by one of said sensors directly to said electrically operated valve to also control the operation of said valve.

13. The processor of claim 11 including a signal source for producing a further electrical signal which is operative to control said valve to compensate for degradation of developer activity resulting from oxidation effects.

14. The processor of claim 13 wherein said coupling means includes adder means for combining said resultant signal and said further signal to produce a composite signal operative to control said valve.

15. The processor of claim 9 wherein said pre-development sensor is operative to produce a signal the magnitude of which is related to the area of a sheet of film present at the processor input, for controlling the amount of replenishment fluid in said initial increment.

* * * * *